United States Patent [19]

Saitoh et al.

[11] Patent Number: 4,990,410

[45] Date of Patent: Feb. 5, 1991

[54] COATED SURFACE REFINED SINTERED ALLOY

[75] Inventors: Takeshi Saitoh; Tuyoshi Saito; Mitsuo Ueki, all of Kawasaki; Hisashi Suzuki, Tokyo; Keiichi Kobori, Kawasaki, all of Japan

[73] Assignee: Toshiba Tungaloy Co., Ltd., Kawasaki, Japan

[21] Appl. No.: 320,059

[22] Filed: Mar. 7, 1989

[30] Foreign Application Priority Data

May 13, 1988 [JP] Japan ..... 63-116351
Sep. 27, 1988 [JP] Japan ..... 63-241268

[51] Int. Cl.[5] ..... B22F 7/00

[52] U.S. Cl. ..... 428/547; 428/552; 428/332; 428/687; 428/610; 75/238; 75/244; 419/13; 419/14; 419/15; 419/16; 419/17; 419/54; 419/57; 419/60

[58] Field of Search ..... 428/547, 687, 610, 552, 428/332; 75/238, 244; 419/10, 13, 14, 17, 54, 57, 60, 16, 15

[56] References Cited

U.S. PATENT DOCUMENTS

| | | | |
|---|---|---|---|
| 3,971,656 | 7/1976 | Rudy | 419/16 |
| 4,342,594 | 8/1982 | Ettmayer et al. | 419/13 |
| 4,587,095 | 5/1986 | Yoshimura et al. | 419/13 |
| 4,639,352 | 1/1987 | Komada et al. | 419/15 |
| 4,769,070 | 9/1988 | Tobioka et al. | 75/238 |
| 4,812,370 | 3/1989 | Okada et al. | 428/552 |
| 4,830,930 | 5/1989 | Taniguchi et al. | 428/547 |
| 4,885,132 | 12/1989 | Brandt et al. | 419/15 |

OTHER PUBLICATIONS

Saitoh et al., "Lo Ni Layer Formed on the Surface Portion of TiC-TiN-$Mo_2C$-Ni System Cermet", Toshiba Tungaloy Co., Ltd. & Chiba Kogyo University (Technology Dept.), pp. 200–201.

*Primary Examiner*—Stephen J. Lechert, Jr.
*Assistant Examiner*—Ngoclan T. Mai
*Attorney, Agent, or Firm*—Foley & Lardner, Schwartz, Jeffery, Schwaab, Mack, Blumenthal & Evans

[57] ABSTRACT

A surface refined sintered alloy with a burnt surface, comprising 75 to 95% by weight of a hard phase containing Ti, C and N as the essential components and otherwise comprising at least one of Zr, Hf, V, Nb, Ta, Cr, Mo and W and the balance of the alloy comprising a binder phase composed mainly of Co and/or Ni and inevitable impurities, wherein the sintered alloy satisfies at least two conditions selected from the group consisting of the following (1) to (3):

(1) the average grain size of the hard phase in a surface layer to the inner portion of 0.05 mm from the burnt surface of the sintered alloy is 0.8 to 1.2-fold of the average grain size of the hard phase in the inner portion of the sintered alloy excluding the surface layer;

(2) the average content of the binder phase in the surface layer to the inner portion of 0.05 mm from the burnt surface of the sintered alloy is 0.7 to 1.2-fold of the average content of the binder phase in the inner portion of the sintered alloy; and (3) the average hardness in the surface layer to the inner portion of 0.05 mm from the burnt surface of the sintered alloy is 0.95 to 1.10-fold of the average hardness in the inner portion of the sintered alloy; and a process for producing the same. The surface refined sintered alloy can be coated with a rigid film.

9 Claims, No Drawings

COATED SURFACE REFINED SINTERED ALLOY

BACKGROUND OF THE INVENTION

This invention relates to a surface refined sintered alloy suitable primarily as the material for construction, including parts for cutting tools, parts for abrasion resistant tools, parts for impact resistant tools or parts for decoration, and a process for producing the same and a coated surface refined sintered alloy comprising a rigid film coated on the surface refined sintered alloy.

N-containing TiC-based sintered alloy comprising the basic composition of TiC-TiN-Ni tends to be more excellent in strength and plastic deformation resistance as compared with non-N-containing TiC based sintered alloy with the basic composition of TiC-Ni. From this fact, the N-containing TiC based sintered alloy tends to be practically applied in wide scope even to the range of heavy cutting region or high feed cutting region when employed as the parts for cutting tool. In these application regions, for necessary of making tool parts low cost, the sintered alloy may be used in some cases without application of the surface of the sintered alloy with polishing or grinding, namely under the surface state after sintering as such under the state of the so-called burnt surface.

The N-containing TiC-based sintered alloy, when used under the state as such of the burnt surface, involves the problem that fracturing or chipping is more liable to occur as compared with the case when it is used under the state of polished or ground surface. As a representative example of the attempt to solve such problems of the surface layer in N-containing TiC-based sintered alloy, there is Japanese Provisional Patent Publication No. 101704/1979.

Japanese Provisional Patent Publication No. 101704/1979 discloses a sintered alloy having a hardness to 0.005 to 0.2 mm from the surface of the sintered alloy in the TiC-based sintered alloy which has been made 1.02-fold or less of the hardness at 1.0 mm from the surface. This Japanese Provisional Patent Publication No. 101704/1979 has inhibited oozing of the metal binder phase by making the oxygen amount larger in the surface portion than in the inner portion by increasing the CO gas partial pressure in the cooling process higher than the CO partial pressure in the temperature elevation and sintering processes in the whole sintering process to make hardness in the surface portion and the inner portion uniform, thereby solving the hardness embrittlement at the surface portion. However, because the concentration gradient of oxygen in the sintered alloy is utilized, oxygen must be used as the essential component and therefore there is involved the problem that the results obtained are still unsatisfactory with respect to strength and fracturing resistance.

SUMMARY OF THE INVENTION

The present invention has solved the problems as mentioned above, and more specifically its object is to provide a N-containing TiC-based sintered alloy and a process for producing the same and also a coated surface refined alloy comprising a rigid film coated on the sintered alloy, by making uniform the average content of binder phase in the surface portion and the inner portion of the N-containing TiC-based sintered alloy according to a method entirely different from Japanese Provisional Patent Publication No. 101704/1979, making uniform the hardness in the surface portion and the inner portion, or making uniform both the contents of binder phases and hardnesses in the surface portion and the inner portion.

The present inventors have studies about the cause for inferior strength and plastic deformation resistance of N-containing TiC-based sintered alloy having burnt surface as compared with N-containing TiC-based alloy comprising a polished surface or a ground surface, and found that, grain size of the hard phase at the surface portion of the burnt surface of the conventional N-containing TiC-based sintered alloy is remarkably roughened as compared with the grain size of the hard phase in the inner portion, while when the grain size at the surface portion of the burnt surface and the inner portion of the sintered alloy is made uniform, strength and plastic deformation resistance of the sintered alloy become excellent, and also, when uniformizing the content of the binder phase simultaneously with uniformization of the grain size of the hard phase at the surface portion of the burnt surface and the inner portion of the sintered alloy, strength and plastic deformation resistance of the sintered alloy become remarkably excellent.

The present inventors have further studied about the cause for inferior strength and fracturing resistance of N-containing TiC-based sintered alloy having burnt surface as compared with N-containing TiC-based alloy comprising a polished surface or a ground surface, and found that, although binder phase is indeed oozed out on the surface and a layer with higher hardness than in the inner portion exists immediately therebelow, the binder phase enriched layer is at most about 10 μm, while the rigid layer has a thickness extending to about 0.5 mm. In other words, formation of the hard layer in the surface portion is not caused mainly by oozing of the binder phase, but mainly by the denitrification phenomenon during the temperature elevation and sintering process. Based on such knowledge, the present inventors obtained a knowledge that strength and fracturing resistance of the sintered alloy can be improved by making uniform the hardness in the surface portion and the inner portion of the sintered alloy, and also that further strength and fracturing resistance can be improved by uniformizing the binder phase content in the surface portion and the inner portion simultaneously with uniformization of hardness. The present invention has been accomplished on the basis of such knowledge.

That is, the surface refined sintered alloy with a burnt surface of the present invention comprises 75 to 95 % by weight of a hard phase containing Ti, C (carbon) and N (nitrogen) as the essential components and otherwise comprising at least one of Zr, Hf, V, Nb, Ta, Cr, Mo and W and the balance of the alloy comprising a binder phase composed mainly of Co and/or Ni and inevitable impurities, wherein said sintered alloy satisfies at least one conditions selected from the group consisting of the following (1) to (3):

(1) the average grain size of the hard phase in a surface layer to the inner portion of 0.05 mm from the burnt surface of said sintered alloy is 0.8 to 1.2-fold of the average grain size of the hard phase in the inner portion of the sintered alloy excluding said surface layer;

(2) the average content of the binder phase in the surface layer to the inner portion of 0.05 mm from the burnt surface of said sintered alloy is 0.7 to 1.2-fold of the average content of the binder phase in the inner portion of the sintered alloy; and (3) the average hardness in the surface layer to the inner portion of 0.05 mm from the burnt surface of said sintered alloy is 0.95 to 1.10-fold of the average hardness in the inner portion of the sintered alloy.

The above coated surface refined sintered alloy of the present invention may further comprise a rigid film having higher hardness than the surface refined sintered alloy covered on the surface of the surface refined sintered alloy.

Also, a process for producing a surface refined sintered alloy with a burnt surface of the present invention comprises, in a sintered alloy comprising 75 to 95 % by weight of a hard phase containing Ti, C and N as the essential components and otherwise comprising at least one of Zr, Hf, V, Nb, Ta, Cr, Mo and W and the balance of the alloy surface comprising a binder phase composed mainly of Co and/or Ni and inevitable impurities from a powdery mixture comprising at least one powder of carbides, nitrides of the metals of the group 4*a*, 5*a*, 6*a* of the periodic table and mutual solid solutions of these and powder mainly composed of Co and/or Ni via a sintering step, wherein the temperature and the atmosphere in said sintering step are controlled such that the atmosphere in said sintering step are controlled such that the atmosphere may be vacuum or an atmosphere of an inert gas in the first temperature region of 1300° C. or lower, nitrogen gas atmosphere of 0.1 to 20 torr in the second temperature range over 1300° C., and further the nitrogen pressue in said second temperature region is made higher as the temperature is higher.

DESCRIPTION OF THE PREFERRED EMBODIMENTS

In the following, the present invention will be described in more detail.

The sintered alloy in the surface refined sintered alloy of the present invention can include all of the component compositions of TiC-based sintered alloys containing N of the prior art, for example, the component compositions described in Japanese Provisional Patent Publication No. 101704/1979, but contains no oxygen as the essential component. Among them, the hard phase constituting the sintered alloy comprises, for example, specifically at least one of TiC, TiN, Ti(C,N), Ti(M,C), (Ti,M)N, (Ti,M)— (C,N) (wherein M represents at least one of Zr, Hf, V, Nb, Ta, Cr, Mo and W), and the other binder phase constituting the sintered alloy comprises at least 50 % by volume of Co and/or Ni of the binder phase, containing otherwise, for example, the metal elements in the compounds forming the hard phase and Fe, Al, Mn, etc.

The burnt surface :n the surface refined sintered alloy of the present invention may include the surface state after sintering, the surface state after washing with water or an organic solvent and drying after sintering, or the surface state from which the attached matters on the burnt surface are removed by sand blast treatment, etc. after sintering, as representative surfaces.

The surface refined sintered alloy of the present invention has the alloy structure in the surface layer to the inner portion of 0.05 mm from the burnt surface of the sintered alloy approximated to the alloy structures in the inner portion, and among said alloy structure, by making the average grain size of the hard phase presented in the surface layer approximate to the average grain size of the hard phase presented in the inner portion by controlling it to 0.8 to 1.2-fold of that of the inner portion, whereby strength and plastic deformation resistance of the sintered alloy have been improved. In addition to the grain size of the hard phases in the surface layer and the inner portion, by controlling the average content of the binder phase presented in the surface layer to 0.7 to 1.2-fold of that of the inner portion, strength and plastic deformation resistance can be further improved. Furthermore, it is more preferred that in addition to the grain size of the hard phases and the average contents of the binder phase in the surface layer and the inner portion, by controlling the average hardness in the surface layer to 0.95 to 1.10-fold of that in the inner portion, strength and stability to plastic deformation resistance of the sintered alloy can be heightened.

The surface refined sintered alloy of the present invention has the average content of the binder phase in the surface layer to the inner portion of 0.05 mm from the burnt surface of the sintered alloy approximated to the average content in the binder phase in the inner portion, by controlling it to 0.7 to 1.2-fold of that of the inner portion, whereby strength and fracturing resistance of the sintered alloy have been improved. Other than the contents in the surface layer and the inner portion, by controlling the average hardness in the surface layer to 0.95 to 1.10-fold of that in the inner portion, strength and fracturing resistance of the sintered alloy can be further improved.

The surface refined sintered alloy of the present invention has the average hardness in the surface layer to the inner portion of 0.05 mm from the burnt surface of the sintered alloy approximated to the average hardness in the inner portion, by controlling the average hardness in the surface layer to 0.95 to 1.10-fold of that in the inner portion, whereby strength and fracturing resistance of the sintered alloy have been improved.

In the surface refined sintered alloy of the present invention, if the average grain size of the hard phase in the surface layer to the inner portion of 0.05 mm from the burnt surface of said sintered alloy is less than 0.8-fold, the average content of the binder phase thereof is less than 0.7-fold or the average hardness thereof exceeds 1.10-fold, deterioration in fracturing resistance becomes remarkable. To the contrary, if the average grain size thereof exceeds 1.2-fold, the average content thereof exceeds 1.2-fold or the average hardness thereof is less than 0.95-fold, deterioration in abrasion resistance becomes remarkable.

The ranges of the average grain size of the hard phase, the average content of the binder phase and the average hardness of the sintered alloy in accordance with the surface refined sintered alloy of the present invention may be those which have been employed in the conventional N-containing TiC-based sintered alloy. In order to heighten both of the abrasion resistance and the fracturing resistance of the sintered alloy, it is particularly preferred that the average grain sizes of the hard phases, the average contents of the binder phases or the average hardnesses of the sintered alloy at the surface layer and the inner portion are substantially equal with each other, respectively.

In producing the surface refined sintered alloy of the present invention, it is important to control the carbon content and the nitrogen content contained in the powdery mixture as the starting material, and further it is important to control minutely the temperature in the sintering step of the production steps and the atmosphere at that time. Particularly, by controlling more minutely the nitrogen pressure in the second temperature region where sintering proceeds together with generation of liquid phase than in the first temperature region in the sintering step, the content of the binder phase and the hardness in the surface layer of the sintered alloy can be controlled. Also, as described above, since formation of the hard layer at the surface portion is caused by the N-eliminating phenomenon in the temperature elevation and sintering processes, it is effective to make the sintered alloy a low carbon alloy from which N can be eliminated with difficulty.

It is also preferred that the surface refined sintered alloy thus obtained may be coated according to, for example, the physical vapor deposition method (PVD method) or the chemical vapor deposition method (CVD method) conventionally practiced in the art, which rigid film having higher hardness than the surface refined sintered alloy, specifically carbides, nitrides, carboxides, nitroxides of the metals of the group 4*a*, 5*a* and 6*a* of the periodic table or mutual solid solution of these and single layer or multi-layer comprising at least one of silicon nitride, silicon carbide, aluminum oxide, aluminum nitride, aluminum oxynitride, cubic boron nitride, diamond, thereby forming a coated surface refined sintered alloy. Particularly, if the coated surface refined sintered alloy is obtained by forming a rigid film comprising a nitride film on the surface of the surface refined sintered alloy by maintaining further the surface of the surface refined sintered alloy after completion of sintering in the second temperature region in the process for producing the surface refined sintered alloy as described above under an atmosphere of high nitrogen pressure for a certain period of time, the steps can be simplified and also no additional installation of equipment is required preferably. The thickness of the rigid film in the coated surface refined sintered alloy is required to be selected depending on the material, use and shape of the rigid film, and practically preferably about 0.1 to 10 μm.

In the surface refined sintered alloy of the present invention, by making the grain size of the hard phase in the surface layer to the inner portion of 0.05 mm from the burnt surface more fine as compared with the sintered alloy of the prior art, stress to the hard phase in the surface layer is dissipated, whereby it has the action of enhancing strength and plastic deformation resistance of the sintered alloy.

The surface refined sintered alloy of the present invention has the action of enhancing strength and fracturing resistance of the sintered alloy by making the average content of binder phase in the surface layer to the inner portion of 0.05 mm from the burnt surface more as compared with the sintered alloy of the prior art.

Also, the process for producing the surface refined sintered alloy of the present invention has the action of inhibiting denitrification in the surface layer of the sintered alloy simultaneously with inhibition of grain growth of hard phase by changing over the atmosphere in the first temperature region to the atmosphere in the second temperature region in the sintering step and increasing gradually the nitrogen pressure with temperature elevation in the second temperature region.

In the present specification, metals of the groups 4*a*, 5*a* and 6*a* of the periodic table mean that metals of the group 4*a* are Ti, Zr and Hf, those of the group 5*a* are V, Nb and Ta and those of the group 6*a* are Cr, Mo and W, respectively.

EXAMPLES

In the following, the present invention will be explained in more detail by referring to Examples.

EXAMPLE 1

By use of respective powders of commercially available TiC, TiN, $Mo_2C$ and Ni having average grain sizes falling within 1 to 2 μm, a composition comprising 40 wt% TiC-30 wt% TiN-15 wt% $Mo_2C$-15 wt% Ni was formulated, and the formulated powder, acetone and balls were placed in a mixing vessel to perform wet mixing and pulverization for 72 hours. To the mixed powder thus obtained, a small amount of paraffin was added, and the mixture was press molded so as to obtain SNMN120408 (shape of JIS standard). After the paraffin was removed by heating from the pressed powder obtained from the press molding, it was sintered by elevating the temperature from room temperature to 1200° C. in vacuum of 0.05 torr over 4 hours, then at 3° C./ min in the atmosphere shown in Table 1 from 1200° C. to 1450° C., and further maintaining the temperature at 1450° C. for one hour. After sintering, the sintered product was cooled at 50° C./min to obtain the sintered alloys 1 to 10 of the present invention and comparative sintered alloys 1 to 4 corresponding to the sintered step of the prior art.

TABLE 1

| | Atmosphere between the respective temperature range (torr) | | | | | |
|---|---|---|---|---|---|---|
| Sample | 1200° C. to 1250° C. | 1250° C. to 1300° C. | 1300° C. to 1350° C. | 1350° C. to 1400° C. | 1400° C. to 1450° C. | Cooling |
| Product of the present invention | | | | | | |
| 1 | Vacuum | Vacuum | 0.1 $N_2$ gas | 0.3 $N_2$ gas | 3 $N_2$ gas | 3 $N_2$ gas |
| 2 | Vacuum | Vacuum | 0.1 $N_2$ gas | 0.5 $N_2$ gas | 5 $N_2$ gas | 5 $N_2$ gas |
| 3 | Vacuum | Vacuum | 0.5 $N_2$ gas | 1 $N_2$ gas | 10 $N_2$ gas | 10 $N_2$ gas |
| 4 | Vacuum | Vacuum | 0.1 $N_2$ gas | 5 $N_2$ gas | 20 $N_2$ gas | 20 $N_2$ gas |
| 5 | Vacuum | Vacuum | 0.1 $N_2$ gas | 0.3 $N_2$ gas | 1 $N_2$ gas | 1 $N_2$ gas |
| 6 | Vacuum | Vacuum | 0.1 $N_2$ gas | 0.5 $N_2$ gas | 2 $N_2$ gas | 2 $N_2$ gas |
| 7 | Vacuum | Vacuum | 0.3 $N_2$ gas | 1 $N_2$ gas | 5 $N_2$ gas | 5 $N_2$ gas |
| 8 | Vacuum | Vacuum | 0.1 $N_2$ gas | 0.3 $N_2$ gas | 2 $N_2$ gas | 2 $N_2$ gas |
| 9 | Vacuum | Vacuum | 0.5 $N_2$ gas | 2 $N_2$ gas | 5 $N_2$ gas | 5 $N_2$ gas |
| 10 | Vacuum | Vacuum | 1 $N_2$ gas | 3 $N_2$ gas | 5 $N_2$ gas | 5 $N_2$ gas |
| Comparative product | | | | | | |
| 1 | Vacuum | Vacuum | Vacuum | Vacuum | Vacuum | Vacuum |
| 2 | 5 $N_2$ gas | 5 $N_2$ gas | 5 $N_2$ gas | 5 $N_2$ gas | 5 $N_2$ gas | 5 $N_2$ gas |
| 3 | 20 $N_2$ gas | 20 $N_2$ gas | 20 $N_2$ gas | 20 $N_2$ gas | 20 $N_2$ gas | 20 $N_2$ gas |

TABLE 1-continued

| Sample | Atmosphere between the respective temperature range (torr) | | | | | |
|---|---|---|---|---|---|---|
| | 1200° C. to 1250° C. | 1250° C. to 1300° C. | 1300° C. to 1350° C. | 1350° C. to 1400° C. | 1400° C. to 1450° C. | Cooling |
| 4 | Vacuum | Vacuum | 20 $N_2$ gas | 20 $N_2$ gas | 20 $N_2$ gas | 20 $N_2$ gas |

The products 1 to 10 of the present invention and the comparative products 1 to 4 thus obtained were subjected to examination of the surface layer and the inner portion by means of a scanning electron microscope (SEM), an electron probe microanalyzer (EPMA) and a Vickers hardness meter to obtain the results shown in Table 2.

TABLE 2

| Sample | Hard phase: Average grain size of inner portion $d_1$ (μm) | Hard phase: Average grain size of surface layer $d_2$ (μm) | $d_2/d_1$ | Binding phase content in surface layer relative to inner portion | Hardness of surface layer relative to inner portion | Rigid film hardness (μm) |
|---|---|---|---|---|---|---|
| Product of the present invention | | | | | | |
| 1 | 1.02 | 1.20 | 1.18 | 0.74 | 1.09 | None |
| 2 | 1.02 | 1.06 | 1.04 | 0.86 | 1.04 | None |
| 3 | 1.00 | 0.99 | 0.99 | 0.97 | 1.00 | 0.8 |
| 4 | 0.98 | 0.96 | 0.98 | 1.13 | 0.96 | 1.3 |
| 5 | 1.02 | 1.22 | 1.20 | 0.65 | 1.15 | None |
| 6 | 1.01 | 1.24 | 1.23 | 0.78 | 1.13 | None |
| 7 | 1.00 | 0.76 | 0.76 | 1.26 | 0.96 | None |
| 8 | 1.02 | 1.21 | 1.19 | 0.82 | 1.11 | None |
| 9 | 0.97 | 0.93 | 0.96 | 1.21 | 0.96 | None |
| 10 | 0.96 | 0.76 | 0.79 | 1.18 | 0.97 | None |
| Comparative product | | | | | | |
| 1 | 1.03 | 2.15 | 2.08 | 0.32 | 1.30 | None |
| 2 | 0.93 | 1.62 | 1.74 | 0.45 | 1.26 | None |
| 3 | 0.88 | 1.36 | 1.55 | 0.57 | 1.20 | None |
| 4 | 0.95 | 1.29 | 1.36 | 0.66 | 1.15 | None |

The grain size of the hard phase shown in Table 2 was measured from an alloy structure photograph of 5000-fold according to SEM. The binder phase content was determined by polishing the sintered alloy to a tilted angle of 10° and measuring the polished surface by use of EPMA under the plane analysis conditions of an acceleration voltage of 20 kV and 20×30 $\mu m^2$ from average value of 5 points. Particularly, binder phase content and hardness were determined as average value of 5 points at equidistance from the surface toward the inner portion, because they are greately flucutuated within the surface layer.

Next, by use of the products 1 to 10 of the present invention and the comparative products 1 to 4, cutting tests were conducted under the conditions (A) and (B) shown below, and the results are shown in Table 3.

(A) Cutting conditions for wear resistance test:

| (A) Cutting conditions for wear resistance test: | |
|---|---|
| Workpiece | S48C ($H_B$ 250) 250 mmθ |
| Tip shape | SNMN432 (0.1 × −30° linear horning) |
| Cutting speed | 160 m/min |
| Depth of cut | 1.5 mm |
| Feed | 0.3 mm/rev |
| Cutting time | 20 min |

(B) Cutting conditions for fracturing resistance test:

| (B) Cutting conditions for fracturing resistance test: | |
|---|---|
| Workpiece | S48C ($H_B$ 230) 120 mmθ with 4 slots |
| Tip shape | SNMN432 (0.1 × −30° linear horning) |
| Cutting speed | 100 m/min |
| Depth of cut | 1.5 mm |
| Feed | 0.3 mm/rev |
| Cutting time | cutting for 10 minutes was repeated for 10 times, and the ratio of fractured tips within 10 minutes was evaluated. |

TABLE 3

| Sample | (A) Wear resistant cutting test: Average flank wear (mm) | (A) Wear resistant cutting test: Face wear (mm) | (B) Ratio of fractured tip by cutting test |
|---|---|---|---|
| Product of the present invention | | | |
| 1 | 0.14 | 0.18 | 5/10 |
| 2 | 0.15 | 0.20 | 3/10 |
| 3 | 0.12 | 0.02 | 1/10 |
| 4 | 0.10 | None | 0/10 |
| 5 | 0.10 | 0.15 | 6/10 |
| 6 | 0.12 | 0.17 | 5/10 |
| 7 | 0.14 | 0.21 | 2/10 |
| 8 | 0.13 | 0.18 | 3/10 |
| 9 | 0.12 | 0.20 | 2/10 |
| 10 | 0.11 | 0.18 | 3/10 |
| Comparative product | | | |
| 1 | 0.13 | 0.16 | 10/10 |
| 2 | 0.13 | 0.17 | 10/10 |
| 3 | 0.14 | 0.17 | 9/10 |
| 4 | 0.14 | 0.18 | 8/10 |

The surface refined sintered alloy of the present invention is equal in wear resistance to N-containing TiC-based sintered of the prior art, but since it is more excellent in strength and plastic deformation resistance, it has also the effect of high fracturing resistance in cutting test which is higher by about 2 to 3-fold. Also, the coated surface refined sintered alloy of the present invention comprising a rigid film coated on the surface refined sintered alloy is remarkably excellent in abrasion resistance and still has the effect of further excellent fracturing resistance. From these facts, the sintered alloy of the present invention has wide scope of uses from those of N-containing TiC-based sintered alloy of the prior art to further those where impact resistance and fracturing resistance are required and is also high in stability. Thus, the present invention provided an industrially useful material and a process for producing the same.

We claim:

1. A surface refined sintered alloy with a burnt surface, comprising 75 to 95 % by weight of a hard phase containing Ti, C (carbon) and N (nitrogen) as the essential components and otherwise comprising at least one of Zr, Hf, V, Nb, Ta, Cr, Mo and W and the balance of the alloy comprising a binder phase composed mainly of Co and/or Ni and inevitable impurities, wherein said sintered alloy satisfies at least two conditions selected from the group consisting of the following (1) to (3):

(1) the average grain size of the hard phase in a surface layer to the inner portion of 0.05 mm from the burnt surface of said sintered alloy is 0.8 to 1.2-fold of the average grain size of the hard phase in the inner portion of the sintered alloy excluding said surface layer;

(2) the average content of the binder phase in the surface layer to the inner portion of 0.05 mm from the burnt surface of said sintered alloy is 0.7 to 1.2-fold of the average content of the binder phase in the inner portion of the sintered alloy; and (3) the average hardness in the surface layer to the inner portion of 0.05 mm from the burnt surface of said sintered alloy is 0.95 to 1.10-fold of the average hardness in the inner portion of of the sintered alloy.

2. A coated surface refined sintered alloy, comprising the surface refined sintered alloy according to claim 1 and a rigid film having higher hardness than said surface refined sintered alloy covered on the surface of said surface refined sintered alloy.

3. A coated surface refined sintered alloy according to claim 2, wherein said rigid film has a thickness of about 0.1 to 10 μm.

4. A surface refined sintered alloy according to claim 1, wherein the hard phase comprises at least one of TiC, TiN, Ti(C,N), Ti(M,C), (Ti,M)N and (Ti,M)(C,N) wherein M represents at least one of Zr, Hf, V, Nb, Ta, Cr, Mo and W.

5. A surface refined sintered alloy according to claim 2, wherein the hard phase comprises at least one of TiC, TiN, Ti(C,N), Ti(M,C), (Ti,M)N and (Ti,M)(C,N) wherein M represents at least one of Zr, Hf, V, Nb, Ta, Cr, Mo and W.

6. A surface refined sintered alloy according to claim 1, wherein the binding phase comprises at least 50 % by volume of Co and/or Ni, and the metal elements in the compounds selected from the group consisting of Ti, Zr, Hf, V, Nb, Ta, Cr, Mo, W, Fe Al and Mn, as the remainder.

7. A surface refined sintered alloy according to claim 2, wherein the binding phase comprises at least 50 % by volume of Co and/or Ni, and the metal elements in the compounds selected from the group consisting of Ti, Zr, Hf, V, Nb, Ta, Cr, Mo, W, Fe Al and Mn, as the remainder.

8. A surface refined sintered alloy as claimed in claim 1, wherein the alloy satisfies the average hardness and at least one of the average grain size and the average content of binder phase in the surface layer to the inner portion of 0.05 mm from the burnt surface.

9. A surface refined sintered alloy as claimed in claim 1, wherein the alloy satisfies the average hardness, average grain size and average content of binder phase in the surface layer to the inner portion of 0.05 mm from the burnt surface.

* * * * *